US009676085B2

(12) United States Patent
Hon et al.

(10) Patent No.: US 9,676,085 B2
(45) Date of Patent: Jun. 13, 2017

(54) WRENCH TOOL AND MANUFACTURING METHOD THEREOF

(71) Applicant: DAHON TECHNOLOGIES, LTD., Shenzhen, Guangdong (CN)

(72) Inventors: David Tak-Wei Hon, Shenzhen (CN); Dongming Huang, Shenzhen (CN); Guangji Deng, Shenzhen (CN)

(73) Assignee: DAHON TECHNOLOGIES, LTD., Shenzhen, Guangdong (CN)

( * ) Notice: Subject to any disclaimer, the term of this patent is extended or adjusted under 35 U.S.C. 154(b) by 0 days.

(21) Appl. No.: 14/646,987

(22) PCT Filed: Oct. 31, 2013

(86) PCT No.: PCT/CN2013/086291

§ 371 (c)(1),
(2) Date: Jun. 29, 2015

(87) PCT Pub. No.: WO2014/079311

PCT Pub. Date: May 30, 2014

(65) Prior Publication Data

US 2015/0298303 A1 Oct. 22, 2015

(30) Foreign Application Priority Data

Nov. 23, 2012 (CN) ..... 2012 1 0478892

(51) Int. Cl.
*B25B 23/00* (2006.01)
*B25B 15/00* (2006.01)
(Continued)

(52) U.S. Cl.
CPC ..... *B25B 23/0028* (2013.01); *B25B 15/008* (2013.01); *B25B 23/0035* (2013.01); *B25G 1/063* (2013.01); *B25G 1/085* (2013.01)

(58) Field of Classification Search
CPC ..... B25B 23/0028; B25B 23/0035; B25B 15/008
(Continued)

(56) References Cited

U.S. PATENT DOCUMENTS 2,631,623 A * 3/1953 West ..... B25B 15/007 81/440
3,191,466 A * 6/1965 Kawashima ..... B25B 13/465 411/403
4,271,731 A * 6/1981 Suligoy ..... B25G 1/063 81/177.7
4,699,030 A * 10/1987 Yang ..... B25B 13/06 7/138
(Continued)

FOREIGN PATENT DOCUMENTS

CN 2071568 U 2/1991
CN 201483430 U 5/2010
(Continued)

OTHER PUBLICATIONS

Patent Cooperation Treaty: International Search Report of PCT/CN2013/086291; Shang, Yupei; Jan. 23, 2014; 8 pages.

*Primary Examiner* — Larry E Waggle, Jr.
*Assistant Examiner* — Danny Hong
(74) *Attorney, Agent, or Firm* — Howison & Arnott, LLP

(57) ABSTRACT

A wrench tool comprises a tool rod and an operating rod. The tool rod is 7-shaped, and comprises a tool head part and a connecting rod part. The connecting rod part is provided with a hinge portion. The hinge portion is provided with a first hinge hole. One end of the operating rod is provided with a tool seat capable of accommodating the hinge portion. The tool seat is provided with a second hinge hole. The tool seat and the hinge portion are hinged together by a pin running through the first hinge hole and the second hinge hole. The wrench tool is simple in structure and flexible in use. Flattening and curling measures are applied to the tool rod, so as to reduce the weight of the tool rod and improve the strength of the tool rod.

4 Claims, 7 Drawing Sheets

(51) Int. Cl.
*B25G 1/06* (2006.01)
*B25G 1/08* (2006.01)

(58) Field of Classification Search
USPC ..... 81/438, 177.8–177.9
See application file for complete search history.

(56) References Cited

U.S. PATENT DOCUMENTS 4,759,645 A * 7/1988 Kuo ..... B25B 13/56
384/396
5,421,180 A * 6/1995 Rojdev ..... B25G 1/005
70/456 R
6,145,413 A 11/2000 Lin
6,314,844 B1 * 11/2001 Warner ..... B25B 15/008
81/177.6
6,412,373 B1 * 7/2002 Hsiao ..... B25B 23/0021
81/177.7
6,640,672 B1 * 11/2003 Cheng ..... B25B 15/02
81/177.2
6,688,196 B2 * 2/2004 Warner ..... B25G 1/063
81/177.6
7,156,002 B1 1/2007 Chan
D571,173 S * 6/2008 Hu ..... D8/27
7,698,972 B2 * 4/2010 Hi ..... B25B 13/465
81/177.7

FOREIGN PATENT DOCUMENTS

CN 102152265 A 8/2011
CN 102975154 A 3/2013

* cited by examiner

WRENCH TOOL AND MANUFACTURING METHOD THEREOF

CROSS-REFERENCE TO RELATED APPLICATIONS

This application is a U.S. National Phase application submitted under 35 U.S.C. §371 of Patent Cooperation Treaty application serial no. PCT/CN2013/086291, filed Oct. 31, 2013, and entitled WRENCH TOOL AND MANUFACTURING METHOD THEREOF, which application claims priority to Chinese patent application serial no. 201210478892.7, filed Nov. 23, 2012, and entitled 扳手工具及其制造方法.

Patent Cooperation Treaty application serial no. PCT/CN2013/086291, published as WO 2014/079311 A1, and Chinse patent application serial no. 201210478892.7, are incorporated by reference herein.

TECHNICAL FIELD

The present disclosure relates to a wrench tool for mounting or dismounting screws and a manufacturing method of the wrench tool.

BACKGROUND

An L-shaped hexagon wrench is a kind of manual tool widely used in the industry, but it feels not so comfortable in use, its tension arm can't be changed as required, and it can't meet the demand of using comfortably both in confined space and in wide-open space. So the applicant of the present application provided a wrench tool capable of changing its tension arm as required, for the details, please refer to Chinese patent application No. 201110041714.3. The wrench tool comprises a controlling element, a connecting element and a rotatable element. The controlling element and the rotatable element can rotate relative to the connecting element respectively, so as to change the tension arm. As the length of the tension arm can be chosen by changing relative positions of elements in the use of the wrench tool, the wrench tool can meet the demand of using in a wide variety of environments, being flexible in use, but its structure is complex and the production cost is high.

SUMMARY AND DESCRIPTION

The present disclosure aims at providing a wrench tool and a manufacturing method thereof, the wrench tool feels comfortable, has simple structure and has lower production cost.

The objects of the present disclosure are achieved by the following technical schemes:

A wrench tool comprises an operating rod and a tool rod; the tool rod is 7-shaped, and comprises a tool head part and a connecting rod part; the connecting rod part is provided with a hinge portion; the hinge portion is provided with a first hinge hole; one end of the operating rod is provided with a tool seat, configured to accommodate the hinge portion; the tool seat has a second hinge hole; the tool seat and the hinge portion are hinged together by a pin running through the first hinge hole and the second hinge hole.

The hinge portion is formed by curling a flattened end of the connecting rod part.

The tool seat is provided with a first locating board and a second locating board respectively at its two opposite open sides.

A counterbore is disposed at a bottom of the tool seat; an elastic member is provided in the counterbore, and a second ball bearing is placed on the elastic member; and a first locating slot and a second locating slot, which are configured to accommodate the second ball bearing, are disposed on surface of the hinge portion.

An inner lining tube is provided in the operating rod, the inner lining tube is open at one end and closed at the other end; the tool seat is connected with the open end of the inner lining tube; the tool seat is provided with a third through hole at its bottom; an elastic member going through the third through hole is provided in the inner lining tube, with one end of the elastic member outwardly extending from the third through hole; a second ball bearing is placed on the elastic member; and a first locating slot and a second locating slot, which are configured to accommodate the second ball bearing, are disposed on surface of the hinge portion.

A handle is sleeved on the outer surface of the operating rod.

The operating rod has a cavity; a sleeve is provided in the cavity; the sleeve is provided with a first inner hexangular nut and a second inner hexangular nut respectively at its two ends.

The operating rod has a cavity; an auxiliary tool head is provided in the cavity; one end of the auxiliary tool head is provided with a third inner hexangular nut, and the other end of the auxiliary tool head is provided with a hexangular head.

The handle is open at one end and closed at the other end; a first annular groove is provided on outer surface of the handle; a taper hole, which is smaller inwards and larger outwards, is provided in the first annular groove of the handle; a first ball bearing is provided in the taper hole; part of the first ball bearing inwardly protrudes from an inner wall of the handle; an annular elastic plate is provided in the annular groove, pressing the first ball bearing in the taper hole; a second annular groove is provided on a corresponding position of the operating rod; when the handle is sleeved on the operating rod, the first ball bearing, which inwardly protrudes from the inner small diameter end of the taper hole, rolls in the second annular groove, getting the handle stuck on the operating rod.

The handle has two open ends and the two open ends communicate with each other; the other end of the operating rod forms an expanded structure; the diameter of the expanded structure is larger than the diameter of at least one of the open ends of the handle; a handle cover is joined to one end of the handle; and the handle cover encloses the expanded structure of the operating rod in the handle.

A manufacturing method of a wrench tool comprises procedures of processing an operating rod, processing a tool rod, and assembling the operating rod and the tool rod; the procedure of processing the operating rod comprises steps of processing a tool seat and punching a second hinge hole in the tool seat; the procedure of processing the tool rod comprises following steps:

Step 1. selecting a profile with a hexagon cross section, and cutting out a segment of the profile;

Step 2. bending the segment cut out into the shape of a tool head part and a connecting rod part;

Step 3. flattening a tail end of the connecting rod part to form a flattened tail end;

Step 4. curling the flattened tail end of the connecting rod part to form a hinge portion with a first hinge hole; and The procedure of assembling the operating rod and the tool rod comprises a step of hinging the hinge portion of the tool rod with the tool seat of the operating rod by a pin.

The wrench tool of the present disclosure comprises the operating rod and the tool rod hinged on the operating rod. The wrench tool has simple structure and is convenient to assemble. It is easy to control the relative positions of the operating rod and the tool rod. The tool rod is 7-shaped, so it is more convenient to change the tension arm of the wrench tool. The handle is sleeved on the operating rod, enclosing the annular elastic plate, the first ball bearing and the second annular groove on the operating rod. The handle is capable of rotating relative to the operating rod. The wrench tool feels comfortable to use. The operating rod has a cavity, which is provided with a sleeve and an auxiliary tool head, so that the wrench tool can mount or dismount screws with other specifications by means of the sleeve and the auxiliary tool head. The tool seat is provided with a first locating board and a second locating board respectively at its two opposite open sides, so as to limit the rotation of the tool rod relative to the operating rod, which facilitates the quick orientation of the tool rod and the operating rod. The present disclosure provides another way of positioning the operating rod and the tool rod as follows: an elastic member is provided at the bottom of the tool seat; a first ball bearing is placed on the elastic member; accurate positioning is realized by either locating the first ball in the first locating slot or locating the first ball in the second locating slot respectively. The present disclosure further provides a wrench tool, whose handle is sleeved on the operating rod through an expanded structure at the end of the operating rod. The expanded structure prevents the handle from being disengaged from the operating rod. The wrench tool has simple structure. The manufacturing method of the wrench tool of the present disclosure comprises procedures of processing the operating rod, processing the tool rod and assembling the operating rod and the tool rod. The tool rod is processed by flattening and curling, which reduces the weight of the tool rod and enhances the strength of the tool rod.

DETAILED DESCRIPTION OF DISCLOSED EMBODIMENTS

The present disclosure will be described in more details with reference to the accompanying figures and embodiments.

Figure 1:
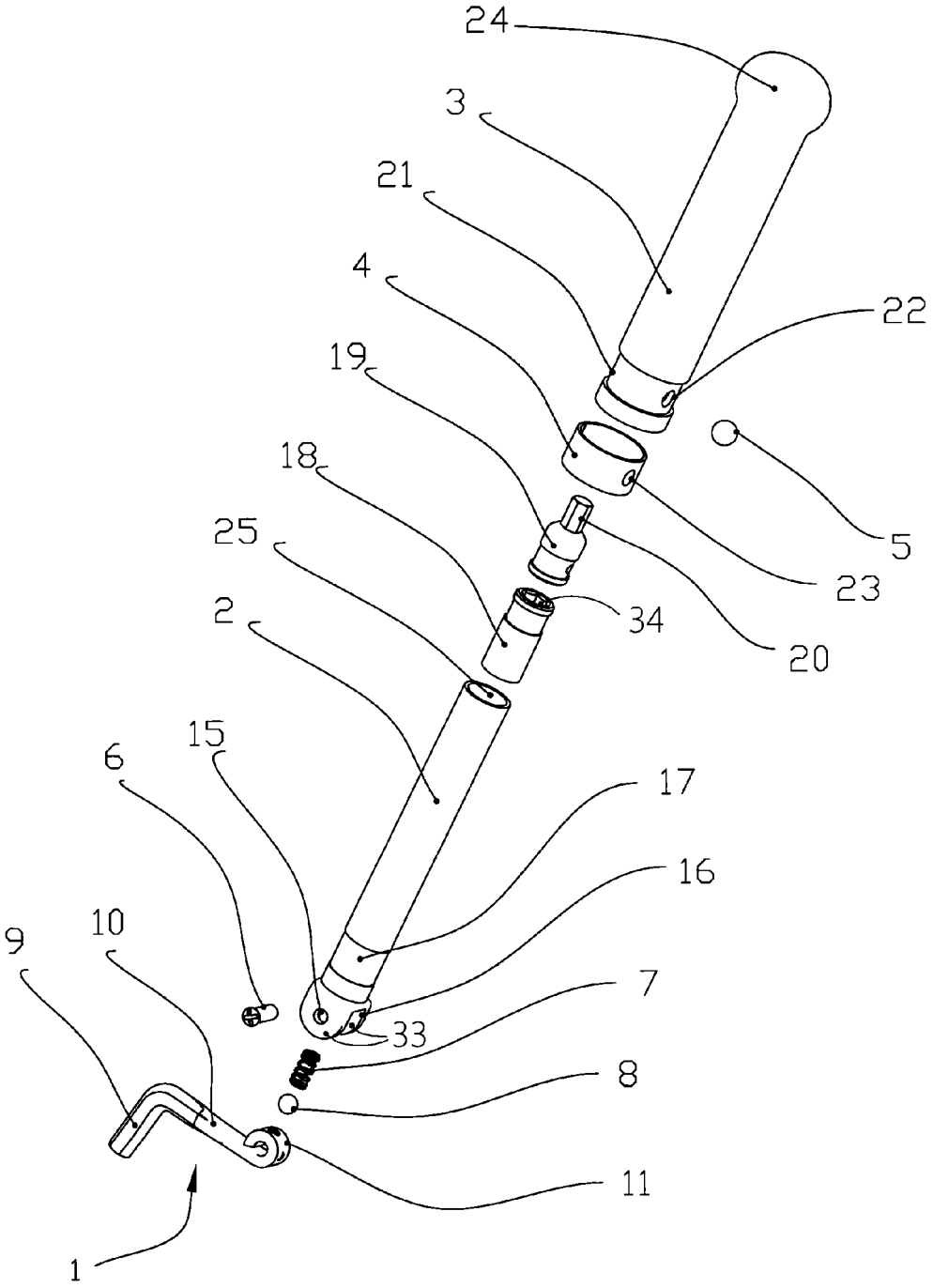
FIG. 1 is an exploded view of the wrench tool according to the first embodiment of the present invention.

As shown in FIG. 1, the wrench tool comprises an operating rod 2 which is open at one end, a tool rod 1 which is hinged at the other end of the operating rod 2, and a handle 3 sleeved on the operating rod 2. The handle 3 is open at one end and closed at the other end. A first annular groove 21 is provided on the handle 3. A taper hole 22 is provided in the first annular groove 21, the taper hole 22 is smaller inwards and larger outwards, and penetrates through the wall of the handle 3, that is, the taper hole 22 has the largest diameter on the outer surface of the handle 3 and has the smallest diameter on the inner wall of the handle 3. A first ball bearing 5 is provided in the taper hole 22, and an annular elastic plate 4 is provided inside the annular groove 21, such that the first ball bearing 5 is disposed between the handle 3 and the elastic plate 4. The diameter of the first ball bearing 5 is smaller than the largest diameter of the taper hole 22, and is greater than the smallest diameter of the taper hole 22. A small part of the first ball bearing 5 provided in the taper hole 22 inwardly protrudes from the inner wall of the handle 3. The elastic plate 4 has a first through-hole 23. The diameter of the first through-hole 23 is smaller than the diameter of the first ball bearing 5, such that a part of the first ball bearing 5 protrudes out of the first through-hole 23, and the first ball bearing 5 is positioned by the first through-hole 23. The closed end of the handle 3 forms a spherical head 24.

One end of the operating rod 2, which is hinged with the tool rod 1, is provided with a tool seat 16. The tool seat 16 has a pair of spaced apart side members 33 and second hinge holes 15. A second annular groove 17 is provided on a corresponding position of the operating rod 2. When the handle 3 is sleeved on the operating rod 2, the first ball bearing 5 inwardly protruding from the inner wall of the handle 3 rolls into the second annular groove 17, and under the action of the elastic plate 4, the first ball bearing 5 gets stuck in the second annular groove 17, so that the handle 3 can't get disengaged from the operating rod 2. As the second annular groove 17 is annular, the handle 3 can be rotated relative to the operating rod 2, which facilitates the use of the wrench tool. When the handle 3 is pulled out with force, the first ball bearing 5, overcoming the elastic force generated by the elastic plate 4, rolls out of the second annular groove 17, and the handle 3 can be disengaged from the operating rod 2.

The tool rod 1 comprises a connecting rod part 10 and a tool head part 9. The tool head part 9 is joined to one end of the connecting rod part 10, forming a 7-shaped structure. The other end of the connecting rod part 10 is provided with a hinge portion 11 formed by curling a flattened structure, specifically, by flattening the tail end of the connecting rod part 10 to form a flattened structure, and curling the flattened structure to form the hinge portion 11, which is provided with a first hinge hole. The tool seat 16 and the hinge portion 11 are hinged together by a pin 6 running through the first hinge hole and the second hinge hole 15.

Figure 2:
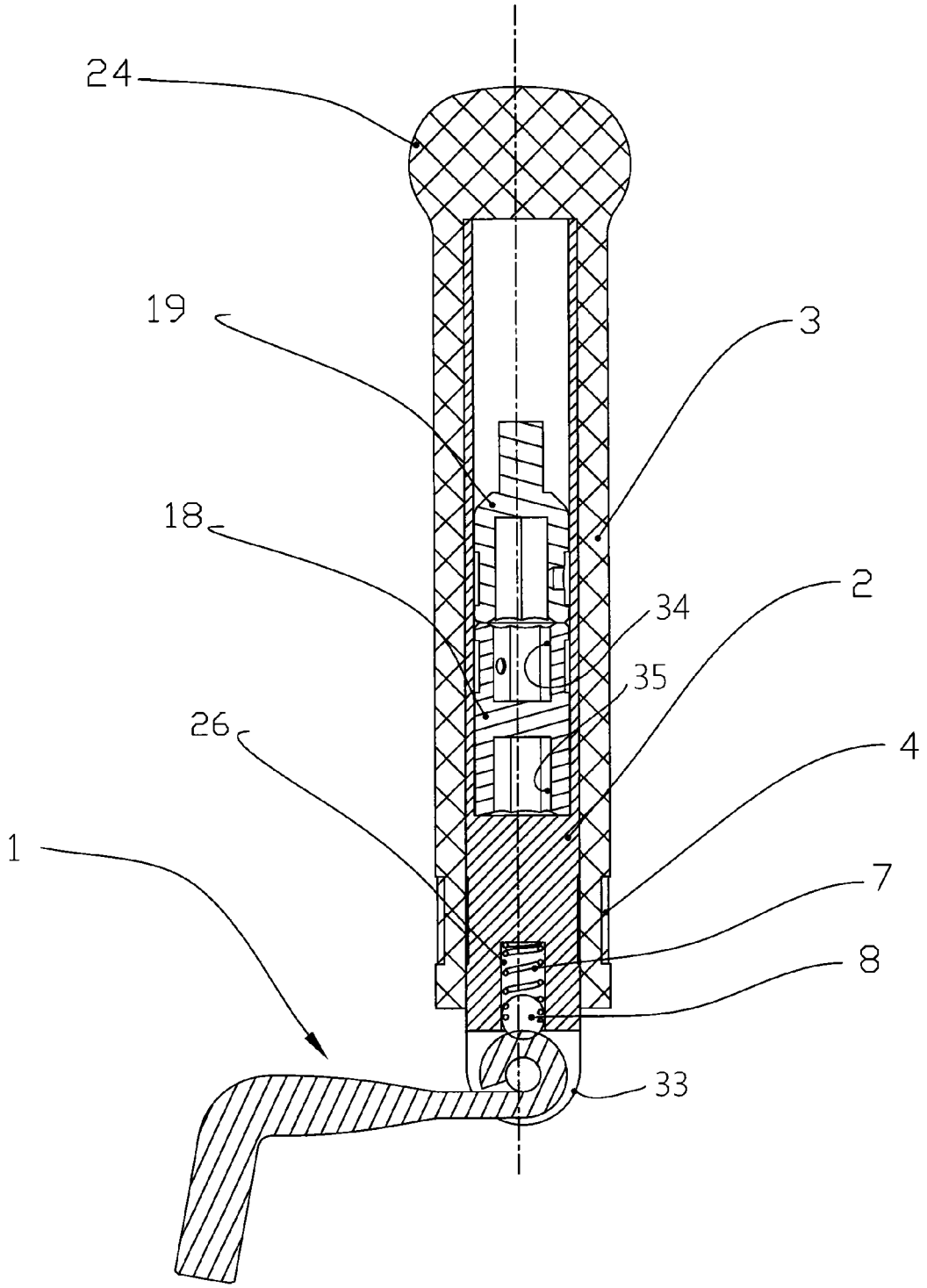
FIG. 2 is a sectional view of the wrench tool according to the first embodiment of the present invention.

As shown in FIG. 2, a counterbore 26 is disposed at the bottom of the tool seat 16. An elastic member 7 is provided in the counterbore 26, and the second ball bearing 8 is placed on the elastic member 7. The operating rod 2 has a cavity, which is open to the open end 25 of the operating rod 2. An auxiliary tool head 19 and a sleeve 18 are provided in the cavity. The sleeve 18 is provided with a first inner hexangular nut 34 and a second inner hexangular nut 35 respectively at its two ends. The first inner hexangular nut matches with the tool head part 9. The second inner hexangular nut is suitable for engaging with a tool head with a hex head at one end and a flat-bladed head at the other end, so as to loosen or tighten cross head screws. One end of the auxiliary tool head 19 is provided with a third inner hexangular nut, which matches with the tool head part 9, and the other end of the auxiliary tool head 19 is provided with a different type of hexagon head 20. When the third inner hexangular nut of the auxiliary tool head 19 is installed on the tool head part 9, the wrench tools can be used to mount or dismount hexagon screws matching with the different type of hexagon head 20.

Figure 3:
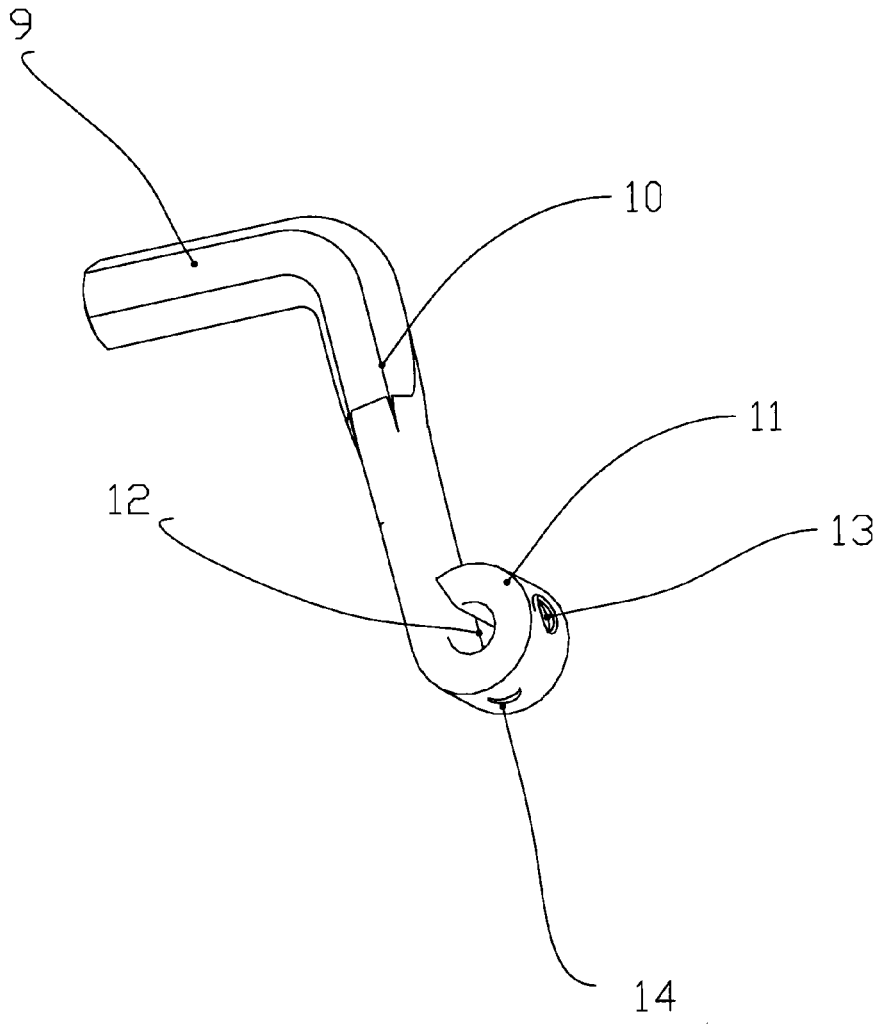
FIG. 3 is a schematic view illustrating the tool rod of the wrench tool according to the first embodiment of the present invention.

As shown in FIG. 3, the hinge portion 11 of the connecting rod part 10 has a first hinge hole 12, and a first locating slot 13 and a second locating slot 14 are disposed on the surface of the hinge portion 11 along the direction of curling. When the second ball bearing 8 is located in the first locating slot 13, the connecting rod part 10 is perpendicular to the operating rod 2, and the wrench tool forms a three-folded structure. In this case, the wrench tool is suitable for mounting or dismounting hexagon head screws disposed in confined space, or screws requiring small tightening force. When the second ball bearing 8 is located in the second locating slot 14, the connecting rod part 10 lies in an extension line of the operating rod 2, and the wrench tool forms a two-folded structure. In this case, the wrench tool has a longer tension arm and is labour-saving when mounting or dismounting hexagon head screws.

Figure 4:
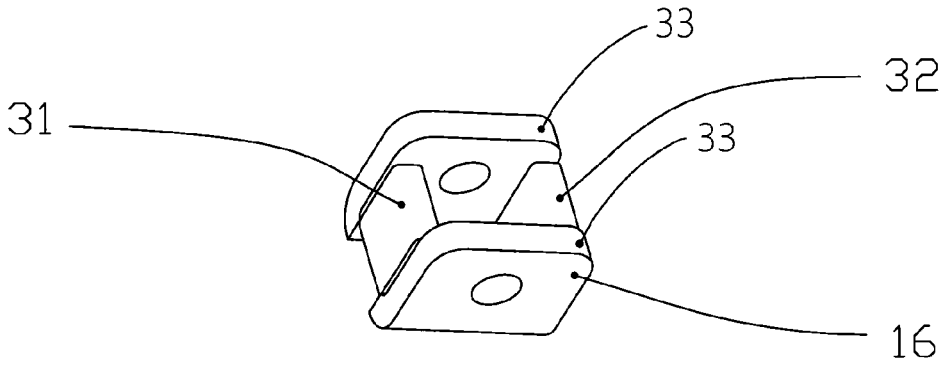
FIG. 4 is a structural schematic view illustrating the tool seat of the wrench tool according to the second embodiment of the present invention.
Figure 5:
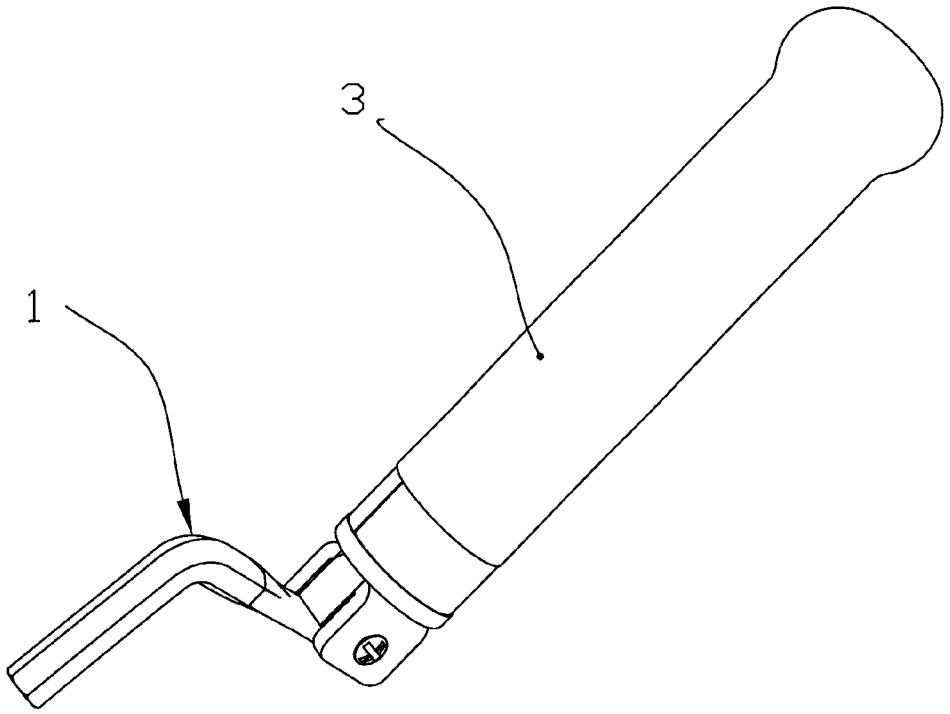
FIG. 5 is a schematic view illustrating one position of the tool seat of the wrench tool according to the second embodiment of the present invention.
Figure 6:
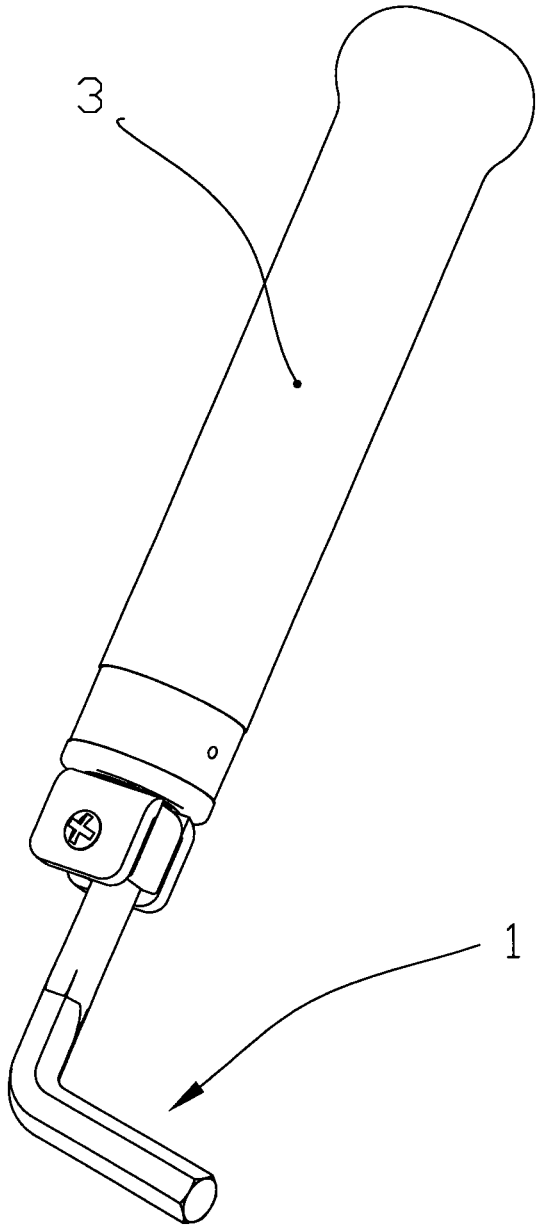
FIG. 6 is a schematic view illustrating another position of the tool seat of the wrench tool according to the second embodiment of the present invention.

The second embodiment of the present invention is shown in FIGS. 4-6. The second embodiment is different from the first embodiment in locating members. In the first embodiment, the locating member is the second ball bearing 8. The wrench tool is positioned through locating the second ball bearing 8 in the first locating slot 13 or in the second locating slot 14. In the second embodiment, the elastic member 7, the second ball bearing 8, the first locating slot 13 and the second locating slot 14 on the hinge portion 11 are omitted. As shown in FIG. 4, in the second embodiment, the tool seat 16 is provided with a pair of spaced apart side members 33 and a first locating board 31 and a second locating board 32 respectively at its two opposite open sides. The first locating board 31 and the second locating board 32 press against two sides of the connecting rod part 10 so as to position the connecting rod part. FIGS. 5 and 6 are schematic views illustrating the different positions of the tool rod 1.

Figure 7:
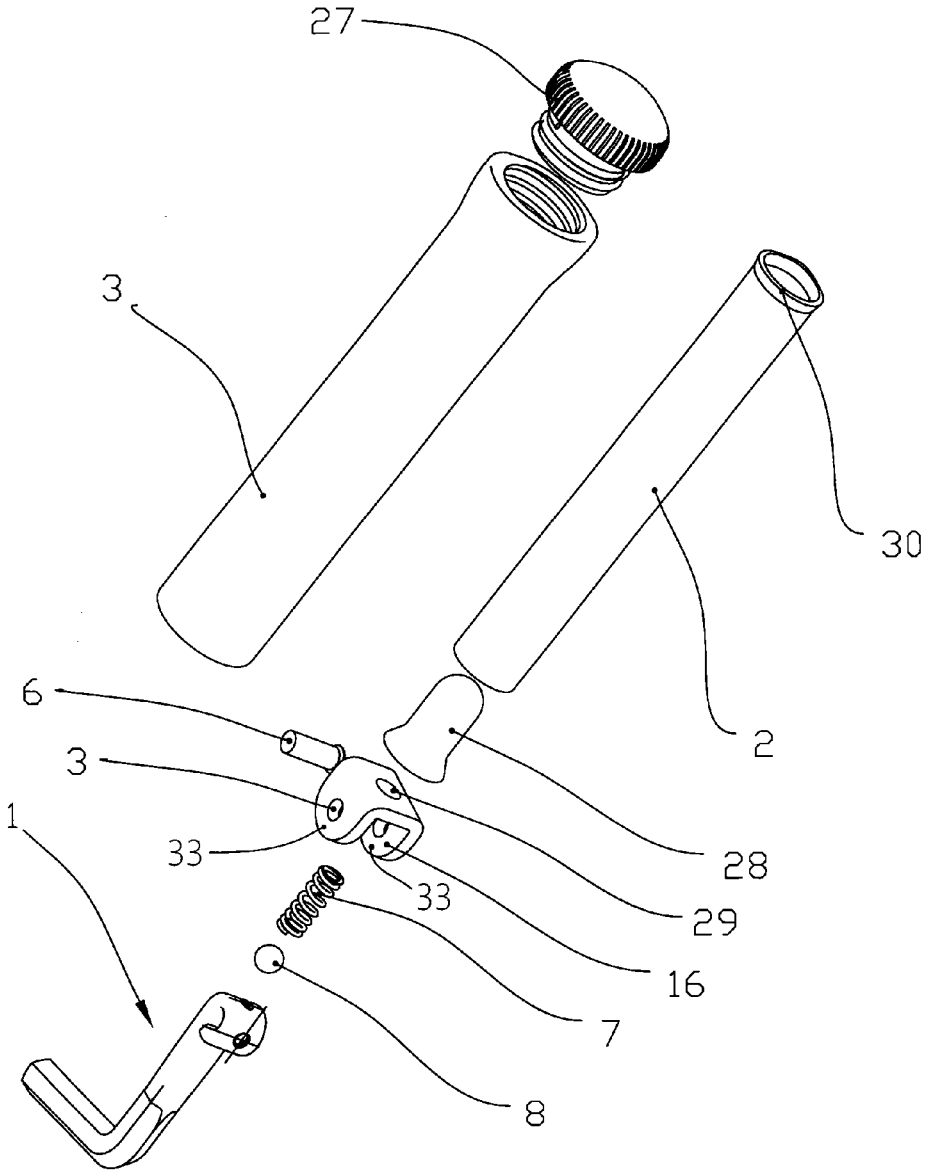
FIG. 7 is an exploded view of the wrench tool according to the third embodiment of the present invention.
Figure 8:
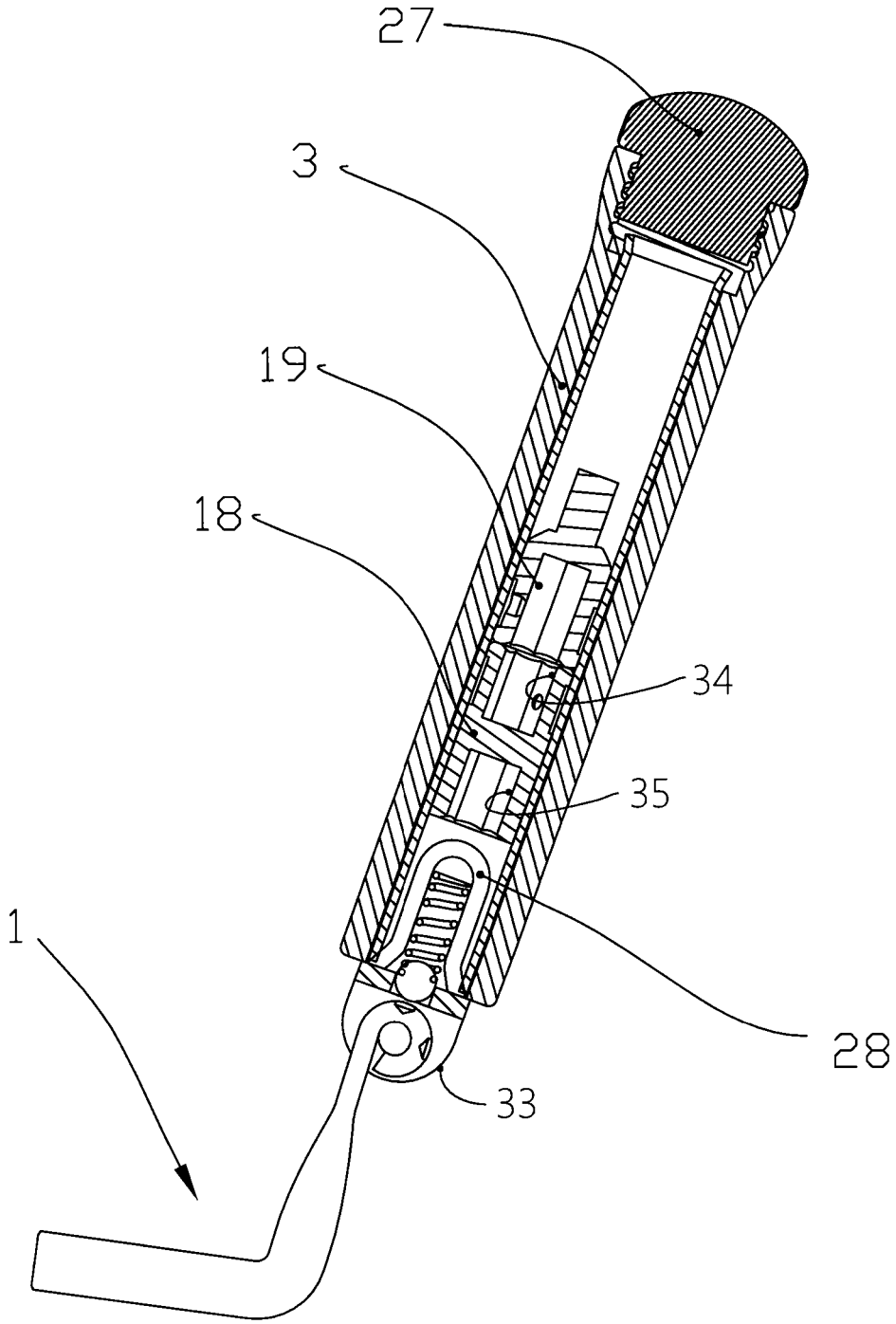
FIG. 8 is a sectional view of the wrench tool according to the third embodiment of the present invention.

The third embodiment of the present invention is shown in FIGS. 7-8. The handle 3 has two open ends and the two open ends communicate with each other. An inner lining tube 28 is provided at one end of the operating rod 2, the inner lining tube 28 is open at one end and closed at the other end. The open end of the inner lining tube 28 is connected with the tool seat 16. The tool seat 16 is U-shaped having a pair of spaced apart side members 33, and a third through hole 29 is provided at the bottom of the tool seat 16. The elastic member 7 going through the third through hole 29 is placed in the inner lining tube 28. The second ball bearing 8 is placed on the free end of the elastic member 7. The tool seat 16 and the inner lining tube 28 are both fixed on the same end of the operating rod 2. The other end of the operating rod 2 is an expanded structure 30. The diameter of the expanded structure 30 is larger than the diameter of at least one of the open ends of the handle 3. One open end of the handle 3 is provided with internal threads, and a handle cover 27 is provided with external threads which engage with the internal threads on the handle 3. After the handle 3 is sleeved on the operating rod 2, the handle cover 27 engaging with the end of the handle 3 encloses the expanded structure 30 of the operating rod 2 in the handle 3. The expanded structure 30 could be formed through other tools after the operating rod 2 and the handle 3 are assembled, which makes the wrench tool be assembled compactly. The defect of the third embodiment is that the assembled structure of the operating rod 2 and the handle 3 will be damaged if the handle has to be replaced.

One manufacturing method of the wrench tool of the present disclosure comprises procedures of processing the operating rod, processing the tool rod, and assembling the operating rod and the tool rod. The procedure of processing the tool rod comprises the following steps:

1. Selecting a profile having a hexagon cross section with a certain specification according to the design dimension of the hexagon screw to be mounted or dismounted, and cut out a segment of the profile;
2. Bending the segment cut out into the shape of the tool head part and the connecting rod part;
3. Flattening the tail end of the connecting rod part to form a flattened structure;
4. Curling the flattened structure of the tail end of the connecting rod part to form the hinge portion with the first hinge hole.
5. Polishing the tool rod;
6. Plating or electrophoresing the tool rod.

The procedure of processing the operating rod comprises the following steps:

1. Selecting a profile with proper dimensions according to the design dimension of the wrench tool;
2. Lathing one end of the profile to form a U-shaped tool seat;
3. Punching out the second hinge hole in the tool seat;
4. Polishing the operating rod;
5. Plating or electrophoresing the operating rod.

The procedure of assembling the operating rod and the tool rod comprises the following step: hinging the hinge portion of the tool rod with the tool seat of the operating rod by a pin running through the first hinge hole and the second hinge hole.

In the procedure of processing the tool rod, by means of flattening and curling, the weight of the tool rod can be reduced and the strength of the tool rod can be enhanced. In the procedure of processing the operating rod, as the U-shaped tool seat is formed by processing one end of the profile directly, the U-shaped tool seat has reliable strength. The manufacturing method of the wrench tool is simple and the processing cost is lower.

Another manufacturing method of the wrench tool of the present disclosure comprises procedures of processing the operating rod, processing the tool rod and assembling the operating rod and the tool rod. The procedure of processing the tool rod comprises the following steps:

1. Selecting a profile having a hexagon cross section with a certain specification according to the design dimension of the hexagon screw to be dismounted, and cut out a segment of the profile;
2. Flattening the tail end of the segment of the profile to form a flattened tail end;
3. Curling the flattened tail end to form the hinge portion with the first hinge hole;
4. Bending the segment of the profile into the shape of the tool head part and the connecting rod part;
5. Polishing the tool rod;
6. Plating or electrophoresing the tool rod.

The procedure of processing the operating rod comprises the following steps:

1. Selecting a hollow profile and a metal plate profile with proper dimensions according to the design dimension of the wrench tool;

2. Punching the metal plate profile to form a U-shaped tool seat, and punching out the second hinge hole in the tool seat;

3. Welding the tool seat to one end of the hollow profile;

4. Polishing the operating rod;

5. Plating or electrophoresing the operating rod.

The procedure of assembling the operating rod and the tool rod comprises the following step: hinging the hinge portion of the tool rod with the tool seat of the operating rod by a pin running through the first hinge hole and the second hinge hole.

In the procedure of processing the operating rod, as the U-shaped tool seat is formed by punching the metal plate profile and is welded to one end of the hollow profile, the procedure is more convenient than forming the U-shaped tool seat through lathing the end of the hollow profile, and the processing cost is lower.

In the above embodiments of the manufacturing method of the wrench tool, in addition to plating and electrophoresing, the antirust surface treating process may further include bluing, blacking, phosphating and other antirust surface treating measures.

What is claimed is:

1. A wrench tool, comprising:

a tool rod including a tool head part and a connecting rod part;

the tool head part having a hexagon cross section and joined to a first end of the connecting rod part to define a 7-shaped structure;

the connecting rod part having a second end provided with a hinge portion defining a first hinge hole;

an operating rod;

wherein a first end of the operating rod is provided with a tool seat;

the tool seat including a pair of spaced apart side members configured to accommodate therebetween the hinge portion of the connecting rod part; and the tool seat having a second hinge hole formed in at least one of the side members; and wherein the tool seat of the operating rod and the hinge portion of the tool rod are hinged together by a pin running through the first hinge hole of the connecting rod part and the second hinge hole of the tool seat; and wherein, the hinge portion of the connecting rod part includes:

the second end having a flattened cross section with respect to the hexagon cross section of the tool head part; and the second end being configured in a curl disposed around the first hinge hole; and further comprising:

a counterbore formed at a bottom of the tool seat;

an elastic member disposed in the counterbore, and a second ball bearing disposed in the counterbore against the elastic member such that the elastic member biases the second ball bearing toward the hinge portion;

a first locating slot disposed at a first position on an outward surface of the hinge portion;

a second locating slot disposed at a second position on the outward surface of the hinge portion; and wherein each of the first locating slot and the second locating slot are configured, respectively, to accommodate the second ball bearing when positioned in line with the counterbore.

2. A wrench tool in accordance with claim 1, wherein:

when the second ball bearing is located in the first locating slot, the connecting rod part is oriented perpendicular to the operating rod, and the wrench tool forms a three-folded structure; and when the second ball bearing is located in the second locating slot, the connecting rod part lies in an extension line of the operating rod, and the wrench tool forms a two-folded structure.

3. A wrench tool, comprising:

a tool rod including a tool head part and a connecting rod part;

the tool head part having a hexagon cross section and joined to a first end of the connecting rod part to define a 7-shaped structure;

the connecting rod part having a second end provided with a hinge portion defining a first hinge hole;

an operating rod;

wherein a first end of the operating rod is provided with a tool seat;

the tool seat including a pair of spaced apart side members configured to accommodate therebetween the hinge portion of the connecting rod part; and the tool seat having a second hinge hole formed in at least one of the side members; and wherein the tool seat of the operating rod and the hinge portion of the tool rod are hinged together by a pin running through the first hinge hole of the connecting rod part and the second hinge hole of the tool seat and wherein, the hinge portion of the connecting rod part includes:

the second end having a flattened cross section with respect to the hexagon cross section of the tool head part; and the second end being configured in a curl disposed around the first hinge hole; and further comprising:

an inner lining tube disposed in the operating rod, the inner lining tube being open at one end and closed at the other end;

the tool seat being connected to the open end of the inner lining tube;

a third through hole formed through a bottom of the tool seat into the open end of the inner tube lining;

an elastic member disposed in the inner lining tube and having one end outwardly extending into the third through hole;

a second ball bearing disposed in the third through hole against the elastic member such that the elastic member biases the second ball bearing toward the hinge portion;

a first locating slot disposed at a first position on an outward surface of the hinge portion;

a second locating slot disposed at a second position on the outward surface of the hinge portion; and wherein each of the first locating slot and the second locating slot are configured, respectively, to accommodate the second ball bearing when positioned in line with the third through hole.

4. A wrench tool, comprising:

a tool rod including a tool head part and a connecting rod part;

the tool head part having a hexagon cross section and joined to a first end of the connecting rod part to define a 7-shaped structure;

the connecting rod part having a second end provided with a hinge portion defining a first hinge hole;

an operating rod;

wherein a first end of the operating rod is provided with a tool seat the tool seat including a pair of spaced apart side members configured to accommodate therebetween the hinge portion of the connecting rod part; and the tool seat having a second hinge hole formed in at least one of the side members; and wherein the tool seat of the operating rod and the hinge portion of the tool rod are hinged together by a pin running through the first hinge hole of the connecting rod part and the second hinge hole of the tool seat and wherein, the hinge portion of the connecting rod part includes:

the second end having a flattened cross section with respect to the hexagon cross section of the tool head part; and the second end being configured in a curl disposed around the first hinge hole; and further comprising a handle sleeved over an outer surface of the operating rod; and, wherein the handle is open at one end and closed at the other end; and further comprising:

a first annular groove is disposed on an outer surface of the handle;

a taper hole, which is smaller inwards and larger outwards, is formed thorough the handle and disposed in the first annular groove of the handle;

a first ball bearing is disposed in the taper hole such that a part of the first ball bearing inwardly protrudes from an inner wall of the handle;

an annular elastic plate is disposed around the annular groove and over the first ball bearing, thereby urging the first ball bearing into the taper hole;

a second annular groove is disposed on a corresponding portion of the outer surface of the operating rod; and wherein when the handle is sleeved on the operating rod, the first ball bearing, which inwardly protrudes from an inner small diameter end of the taper hole, rolls in the second annular groove, removably rotatably securing the handle on the operating rod.

* * * * *